US012643004B2

(12) United States Patent
Hibberts et al.

(10) Patent No.: US 12,643,004 B2
(45) Date of Patent: Jun. 2, 2026

(54) ADJUSTABLE BENCH

(71) Applicant: Rep Fitness, LLC, Boulder, CO (US)

(72) Inventors: John Hibberts, Denver, CO (US); Samuel M. Pizer, Denver, CO (US); Ryan James McGrotty, Erie, CO (US)

(73) Assignee: Rep Fitness, LLC, Boulder, CO (US)

( * ) Notice: Subject to any disclaimer, the term of this patent is extended or adjusted under 35 U.S.C. 154(b) by 145 days.

(21) Appl. No.: 18/449,251

(22) Filed: Aug. 14, 2023

(65) Prior Publication Data

US 2024/0066350 A1 Feb. 29, 2024

Related U.S. Application Data

(60) Provisional application No. 63/373,235, filed on Aug. 23, 2022.

(51) Int. Cl.
*A63B 21/00* (2006.01)

(52) U.S. Cl.
CPC .... *A63B 21/4029* (2015.10); *A63B 2225/096* (2013.01)

(58) Field of Classification Search
CPC ..... A63B 21/4029; A63B 2225/096; A63B 2225/09; A63B 21/4031
See application file for complete search history.

(56) References Cited

U.S. PATENT DOCUMENTS

| | | | |
|---|---|---|---|
| 4,207,879 | A | 6/1980 | Safadago et al. |
| 4,468,025 | A | 8/1984 | Sferle |
| D277,219 | S | 1/1985 | Johnson |
| 4,621,809 | A | 11/1986 | Pearl |
| 4,871,166 | A | 10/1989 | Sterba et al. |
| 4,911,501 | A | 3/1990 | Decker |

(Continued)

FOREIGN PATENT DOCUMENTS

| | | |
|---|---|---|
| AU | 2021215163 A1 | 9/2021 |
| CN | 202230428093 | 7/2022 |

(Continued)

OTHER PUBLICATIONS

AlphaFit Core Adjustable Utility AlphaBench, located on Instagram on Mar. 6, 2023 at: https://www.instagram.com/p/CRtCOKtEUg/?utm_source=ig_web_copy_link, offered for sale as early as Feb. 16, 2022, 2 pages.

(Continued)

*Primary Examiner* — Andrew M Kobylarz
(74) *Attorney, Agent, or Firm* — NOD Law PC

(57) ABSTRACT

An adjustable bench includes a frame and a hinge. A back support is pivotably coupled to the hinge and has a back cushion. A seat support has a first end defining apertures, a second end pivotably coupled to the hinge, and a seat cushion. A leg support is pivotably coupled to the first end at a pivot point defining a rotation axis for the leg support. The leg support is selectively engageable with one of the apertures via a pin. In a first configuration, the pin also engages with the leg support to define a fixed angular position of the leg support relative to the seat support. In a second configuration, the pin is engaged with one of the apertures without capturing the leg support such that the pin defines a rotational stop for the leg support and the leg support is movable at least partially around the rotational axis.

20 Claims, 8 Drawing Sheets

(56) References Cited

U.S. PATENT DOCUMENTS

| | | | | |
|---|---|---|---|---|
| 4,915,377 | A | 4/1990 | Malnke et al. | |
| 5,370,595 | A | 12/1994 | Voris et al. | |
| 5,637,059 | A | 6/1997 | Dalebout | |
| 5,716,308 | A * | 2/1998 | Lee | A63B 23/00 482/130 |
| 5,803,884 | A | 9/1998 | Sharp | |
| D406,290 | S | 3/1999 | McBride | |
| 5,906,566 | A * | 5/1999 | Whitcomb | A63B 21/0552 482/133 |
| D425,153 | S | 5/2000 | Grider | |
| 6,287,243 | B1 | 9/2001 | Isom et al. | |
| D455,803 | S | 4/2002 | Webber | |
| 6,371,896 | B1 | 4/2002 | Kettler | |
| 6,605,023 | B1 | 8/2003 | Mobley | |
| 6,659,923 | B2 * | 12/2003 | Teuscher | A63B 21/4029 482/148 |
| 6,666,802 | B1 | 12/2003 | Rasmussen | |
| 6,939,272 | B1 | 9/2005 | Wu | |
| 6,966,872 | B2 | 11/2005 | Eschenbach | |
| 7,153,249 | B2 | 12/2006 | O'Connor | |
| 7,331,912 | B2 | 2/2008 | Keiser | |
| 7,465,260 | B2 | 12/2008 | Hockemeyer | |
| 7,604,580 | B2 | 10/2009 | Lamarque | |
| 9,022,911 | B2 | 5/2015 | Goldberg | |
| 9,168,416 | B2 | 10/2015 | Ho | |
| 9,707,438 | B2 | 7/2017 | Vorozilchak | |
| D806,809 | S | 1/2018 | Orellana | |
| D820,362 | S | 6/2018 | Citterio | |
| 10,398,929 | B2 * | 9/2019 | Hsieh | A63B 21/4029 |
| 10,589,144 | B2 | 3/2020 | Specht | |
| 10,675,502 | B2 * | 6/2020 | Hallmark | A63B 21/4029 |
| D907,144 | S | 1/2021 | Zhao | |
| D933,762 | S | 10/2021 | Wang | |
| D933,763 | S | 10/2021 | Wang | |
| D934,358 | S | 10/2021 | Huang | |
| D939,033 | S | 12/2021 | McGrotty | |
| D943,688 | S * | 2/2022 | Lu | D21/686 |
| D986,360 | S | 5/2023 | Dai | |
| D1,027,084 | S * | 5/2024 | Zhang | D21/676 |
| 11,992,722 | B2 * | 5/2024 | Baker | A63B 23/00 |
| 2003/0050157 | A1 | 3/2003 | Teuscher | |
| 2003/0199373 | A1 | 10/2003 | Savage | |
| 2006/0035772 | A1 | 2/2006 | Golesh | |
| 2007/0155604 | A1 | 7/2007 | Hockemeyer | |
| 2007/0155605 | A1 | 7/2007 | Hockemeyer | |
| 2013/0113254 | A1 | 5/2013 | Augustat | |
| 2016/0114204 | A1 | 4/2016 | Swanson | |
| 2017/0001064 | A1 | 1/2017 | Vorozilchak | |
| 2017/0259109 | A1 | 9/2017 | McJames, II | |
| 2018/0099176 | A1 * | 4/2018 | Specht | A63B 21/4029 |
| 2018/0206647 | A1 | 7/2018 | Kieryllo | |
| 2019/0151699 | A1 | 5/2019 | Isom et al. | |
| 2019/0159603 | A1 | 5/2019 | Triglia | |
| 2022/0176190 | A1 | 6/2022 | Pena | |
| 2022/0339489 | A1 | 10/2022 | Zhao | |
| 2023/0027387 | A1 | 1/2023 | Augustin | |
| 2023/0264069 | A1 | 8/2023 | McGrotty | |

FOREIGN PATENT DOCUMENTS

| | | |
|---|---|---|
| EP | 0208208 | 1/1987 |
| GB | 2195090 | 3/1988 |
| GB | 6245218 | 11/2022 |
| GB | 6263942 | 2/2023 |
| GB | 6263943 | 2/2023 |
| GB | 6273610 | 4/2023 |

OTHER PUBLICATIONS

Amazon.com, Rep Fitness Adjustable Bench—AB-3000 FID—1,000 lb rated—Flat/Inclide/Decline, located on Internet WayBack Machine archive on Dec. 11, 2022 at: http://web.archive.org/web/20221211060537/https://www.amazon.com/Rep-Fitness-Adjustable-Bench-AB-3000/dp/B00YNS7D9G, offered for sale as early as Nov. 18, 2021, 9 pages.

BENQ Medical Technology Corp., TriMax 650NS Series brochure, 2015, http://www.xcelsitas.com/index.php/selected2/trimax-650ns-series.html, 6 pages.

Force Manila, Tiger Force AB-6000 FOD Zero Gap Adjustable Bench, located on Instagram on Mar. 6, 2023 at: https://www.instagram.com/p/CKDLbRcgD7H/?utm_source=ig_web_copy_link, offered for sale as early as Aug. 23, 2022, 2 pages.

Garage Gym Reviews, Weight Bench, REP AB-3000 2.0, published online on Jan. 17, 2023, retrieved on Aug. 2, 2023: https://www.youtube.com/watch?v=HBCiYM1kK7k, 2023.

Gluck's Gym, Adjustable Weight Bench Rep AB-5200 2.0, published online on Jul. 25, 2023, retrieved online on Aug. 1, 2023: https://www.youtube.com/watch?v=KWchqGDfVv8, 2023.

Griffin Fitness, Adjustable FID Bench, located on Internet WayBack Machine archive on Dec. 6, 2022 at: http://web.archive.org/web/20221206233334/https://griffin.fitness/strength-equipment/griffin-adjustable-fid-bench/, offered for sale as early as Sep. 21, 2021, 6 pages.

Rep Fitness AB-3100 Adjustable Weight Bench, located on Internet WayBack Machine archive at: http://web.archive.org/web/20230115021825/https://repfitness.com/collections/adjustable-weight-benches/products/ab-3100-adjustable-weight-bench on Jan. 15, 2023, offered for sale at least before Jan. 7, 2022, 4 pages.

Rep Fitness AB-5200 Adjustable Weight Bench located on Internet WayBack Machine archive on May 23, 2022 at: http://web.archive.org/web/20220523022754/https://repfitness.com/collections/adjustable-weight-benches/products/ab-5200-adjustable-weight-bench, offered for sale at least before Jul. 24, 2021, 5 pages.

Rep Fitness, AB-5000 Zero Gap Adjustable Bench, located on Internet WayBack Machine archive on May 23, 2022 at: http://web.archive.org/web/20220523022831/https://repfitness.com/collections/adjustable-weight-benches/products/ab-5000-zero-gap-adjustable-bench, 4 pages.

REP, AB-4100 Adjustable Weight Bench, published online on Jan. 5, 2023, retreieved online on Aug. 4, 2023: https://repfitness.com/products/ab-4100-adjustable-weight-bench?variant=41393677631646, 2023.

Vulcan Strength, Vulcan Flat/Incline/Decline Adjustable Bench, located on Internet WayBack Machine archive on Oct. 22, 2022 at: http://web.archive.org/web/20201022055330/https://www.vulcanstrength.com/Vulcan-FID-Bench-p/v-idb.htm, offered for sale as early as Oct. 22, 2020, 4 pages.

Extended European Search Report issued Jan. 4, 2024 in counterpart European application, No. 23192888.8. 8 pages.

European Patent Application No. 23192888.8, Communication pursuant to Article 94(3) EPC dated Feb. 19, 2025. 6 pages.

* cited by examiner

ADJUSTABLE BENCH

CROSS-REFERENCE TO RELATED APPLICATIONS

This application claims the benefit of priority to U.S. Provisional Application No. 63/373,235, filed Aug. 23, 2022, which application is hereby incorporated in its entirety by reference.

INTRODUCTION

Some exercises are performed while lying down or seated on a bench. Such exercises can be performed while holding or using supplemental exercise equipment, such as weights, resistance bands, exercise balls, etc. Benches or seats used when performing these exercises may be in a public facility, such as a gym, or a private facility, such as in home.

SUMMARY

In one aspect, the technology relates to an adjustable bench including: a frame; a hinge coupled to the frame; a back support having an end pivotably coupled to the hinge; a back cushion coupled to the back support; a seat support having a first seat support end defining a plurality of apertures and a second seat support end pivotably coupled to the hinge; a seat cushion coupled to the seat support; a leg support pivotably coupled to the first seat support end at a pivot point defining a rotation axis for the leg support relative to the seat support; and a pin, wherein the leg support is selectively engageable with one of the plurality of apertures via the pin in at least a first configuration and a second configuration, wherein in the first configuration, the pin also engages with the leg support to define a fixed angular position of the leg support relative to the seat support, and wherein in the second configuration, the pin is engaged with one of the plurality of apertures without capturing the leg support such that the pin defines a rotational stop for the leg support and the leg support is movable at least partially around the rotational axis.

In an example, the leg support includes a pin receiver that selectively corporates with each of the plurality of apertures to receive the pin in the first configuration. In another example, at least one notch is defined on the leg support to at least partially receive the pin in the second configuration. In yet another example, the plurality of apertures are circumferentially spaced relative to the pivot point. In still another example, a strut is coupled between the seat support and the frame, the strut having an adjustable length so as to define a pivot angle position of the seat cushion relative to horizontal. In an example, the strut is pivotably coupled to both the seat support and the frame.

In another example, the seat cushion is tapered, and the seat cushion is removable coupled to the seat support such that the seat cushion is configured to be oriented in at least two different directions. In yet another example, a front foot is secured to the frame and disposed at least partially under the seat cushion, the front foot has a front end facing the leg support and an opposite rear end facing the back support, and the frame is positioned towards the rear end and within the rear third of a length of the front foot between the front end and the rear end. In still another example, a front foot is secured to the frame and disposed at least partially under the seat cushion, the front foot has a width defined parallel to the rotation axis, the width of the front foot at least three times more than a width of the frame defined parallel to the rotational axis. In an example, a rear lateral support is secured to the frame and disposed at least partially under the back cushion, the lateral support has a length defined parallel to the rotational axis, the length of the lateral support at least twice more than a width of the back cushion defined parallel to the rotational axis. In another example, an adjustment ladder is secured to the frame; and a brace extends from and pivotably connected to the back support, a terminal end of the brace is selectively engageable with the adjustment ladder, and positioning of the brace along the adjustment ladder adjusts a position of the back support relative to the frame, the adjustment ladder including of a plurality of gaps defined in the adjustment ladder and configured to selectively receive the terminal end of the brace, the adjustment ladder defining angular positions of the back cushion relative to horizontal consisting of 85°, 70°, 60°, 45°, 30°, 15°, 0°, and −12°.

In yet another example, the frame includes a leg seat portion disposed at least partially under the seat support and a leg back portion disposed at least partially under the back support, the leg seat portion and the leg back portion being straight tubular components.

In another aspect, the technology relates to an adjustable bench including: a frame; a hinge coupled to the frame; a back support having an end pivotably coupled to the hinge; a back cushion coupled to the back support; a seat support having a first seat support end and a second seat support end pivotably coupled to the hinge; a seat cushion coupled to the seat support; a strut coupled between the seat support and the frame, the strut having an adjustable length so as to define a pivot angle position of the seat cushion; and a leg support pivotably coupled to the first seat support end at a pivot point defining a rotation axis for the leg support relative to the seat support, wherein the leg support is selectively engageable with the seat support in at least a first configuration and a second configuration, in the first configuration, the leg support engages with the seat support such that the leg support is fixed at a predefined angular position relative to the rotation axis, and in the second configuration, the leg support engages with the seat support such that a rotational stop is formed, the leg support at least partially freely rotatable about the rotational axis on one side of the rotational stop.

In an example, a pin is configured to selectively engage with the seat support and the leg support to define the first configuration and the second configuration. In another example, a plurality of apertures are defined within the seat support and a pin receiver is defined within the leg support, each of the plurality of apertures and the pin receiver configured to receive at least a portion of the pin. In yet another example, the leg support has a first side and an opposite second side, each of the first and second sides having a notch shaped and sized to at least partially receive the pin when in the second configuration. In still another example, the first configuration has a plurality of predefined angular positions. In an example, the strut is disposed between the leg support and the hinge.

In another example, the seat cushion is removably coupled to the seat support, the seat cushion configured to secure to the seat support in at least two different orientations.

In another aspect, the technology relates to an adjustable bench including: a frame; a hinge coupled to the frame; a back support having an end pivotably coupled to the hinge; a back cushion coupled to the back support; a seat support having a first seat support end and a second seat support end pivotably coupled to the hinge, the first seat support end having a plurality of apertures defined therein; a seat cushion coupled to the seat support; a strut coupled between the seat support and the frame, the strut having an adjustable length so as to define a pivot angle position of the seat cushion; a leg support pivotably coupled to the first seat support end at a pivot point disposed at least partially above the plurality of apertures and defining a rotation axis for the leg support relative to the seat support, the leg support including a pin receiver; and a pin, wherein in a first configuration, the pin engages with one of the plurality of apertures and the pin receiver to define a fixed angular position of the leg support relative to the seat support, and in a second configuration, the pin only engages with one of the plurality of apertures such that a rotational stop is formed and the leg support is at least partially freely rotatable on one side of the pin.

The details of one or more examples are set forth in the accompanying drawings and the description below. Other features, objects, and advantages of these examples will be apparent from the description, drawings, and claims. Moreover, it is to be understood that both the foregoing summary of the disclosure and the following detailed description are exemplary and intended to provide further explanation without limiting the scope of the disclosure.

BRIEF DESCRIPTION OF THE DRAWINGS

The following drawing figures, which form a part of this application, are illustrative of described technology and are not meant to limit the scope of the disclosure as claimed in any manner, which scope shall be based on the claims appended hereto.

DETAILED DESCRIPTION

Examples of the present technology are directed to an adjustable bench that includes a leg support extending from a seat support. The leg support is selectively engageable with the seat support in at least two different configurations. In a first configuration, the leg support is fixed at an angular extension position relative to the seat support for use. In a second configuration, the leg support is freely rotatable relative to the seat support but for a rotational stop that is formed. The second configuration allows the user to swing the leg support in a first position for use and then allow the leg support to swing towards a second position that is considered stored and out of the way. In the second configuration, disengagement of a pin is not needed for swinging the leg support between different positions. The configuration of the leg support is independent from the adjustable positions of the seat support and a back support so that the leg support can be selectively engaged in either the first configuration or the second configuration no matter the use position of the rest of the adjustable bench. This facilitates more adjustability and performance for the adjustable bench. Additionally, the adjustable bench includes features that increase stability and streamline manufacturing.

Figure 1:
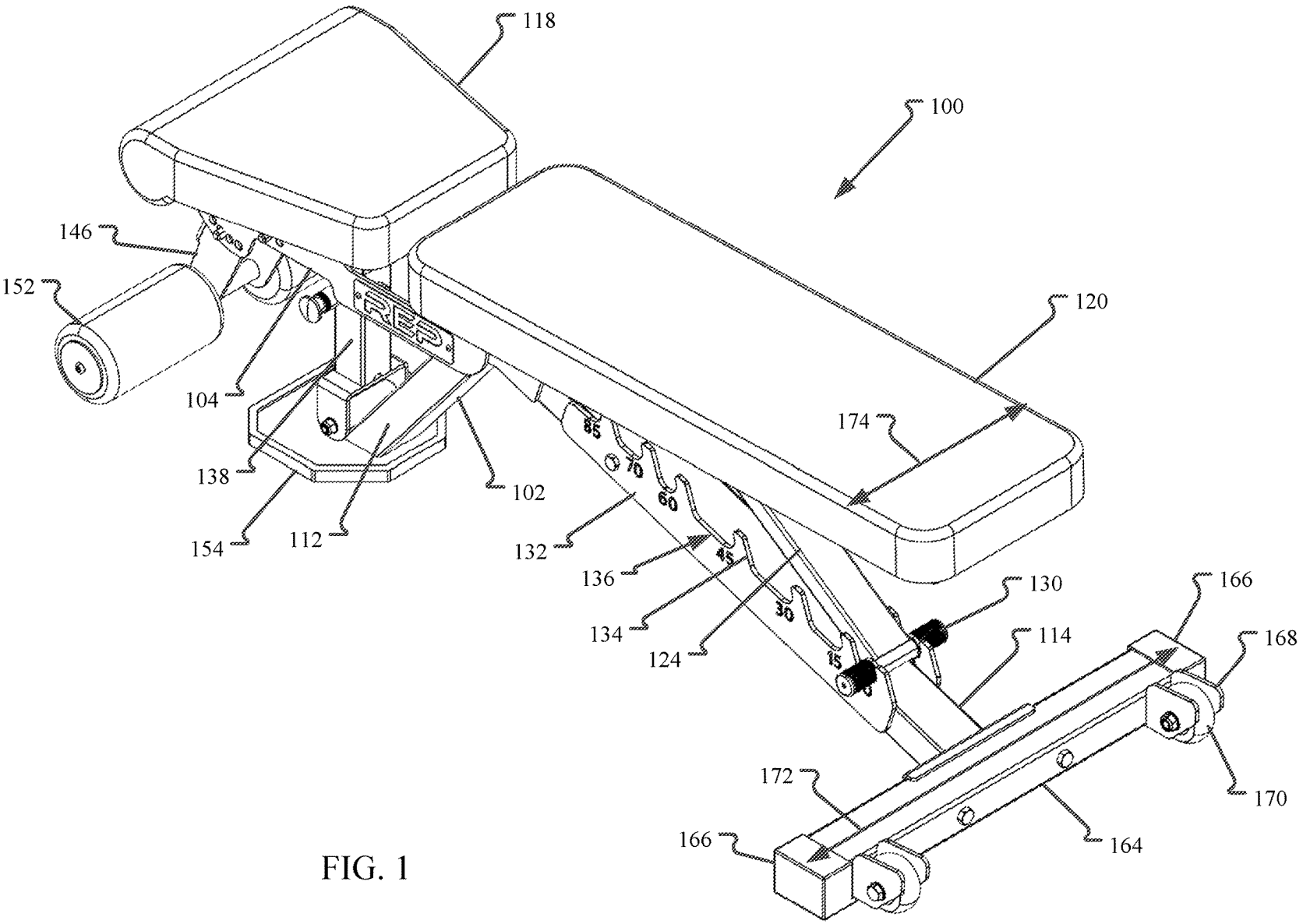
FIG. 1 depicts a top perspective view of an exemplary adjustable bench.
Figure 2:
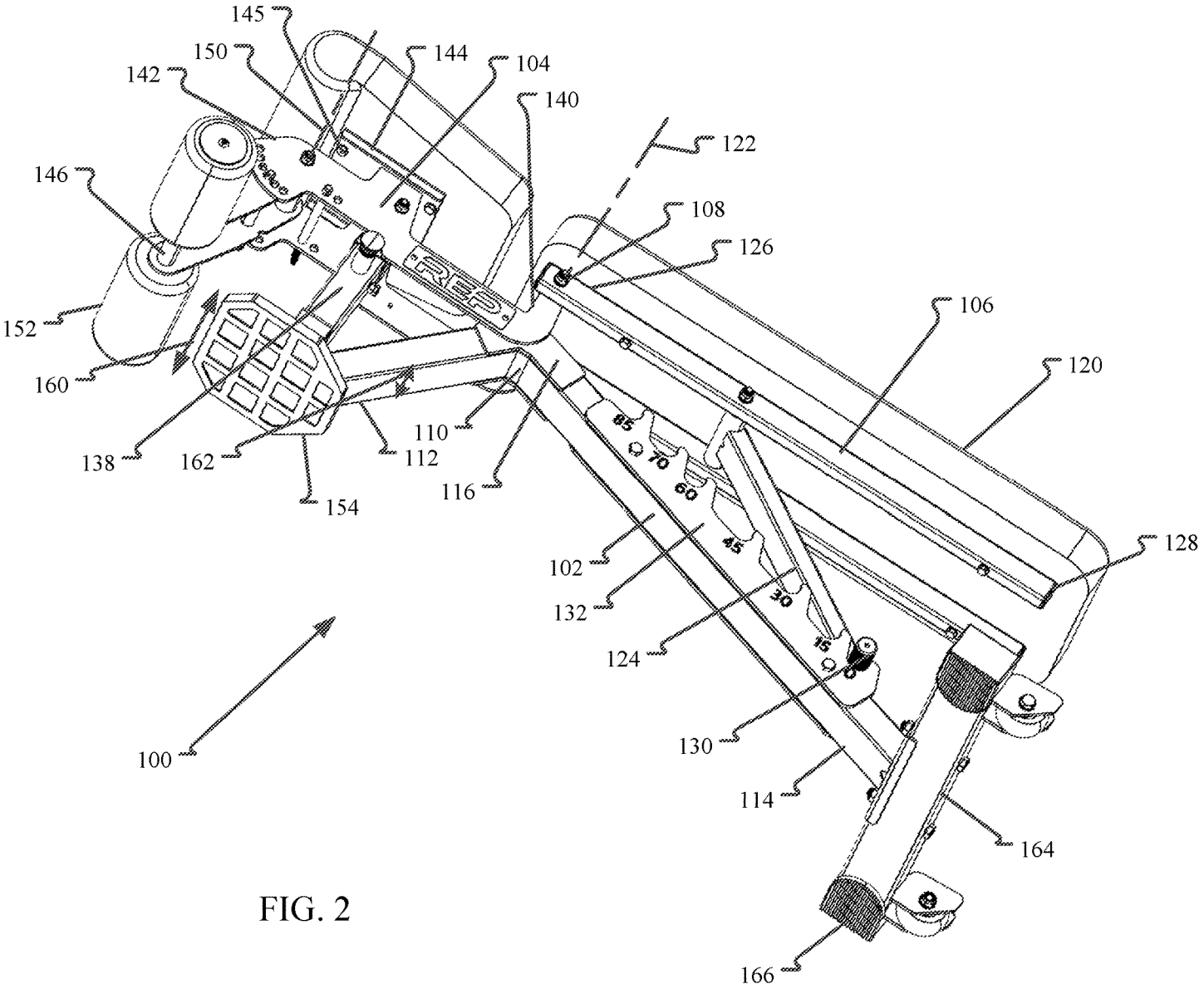
FIG. 2 depicts a bottom perspective view of the adjustable bench.
Figure 3:
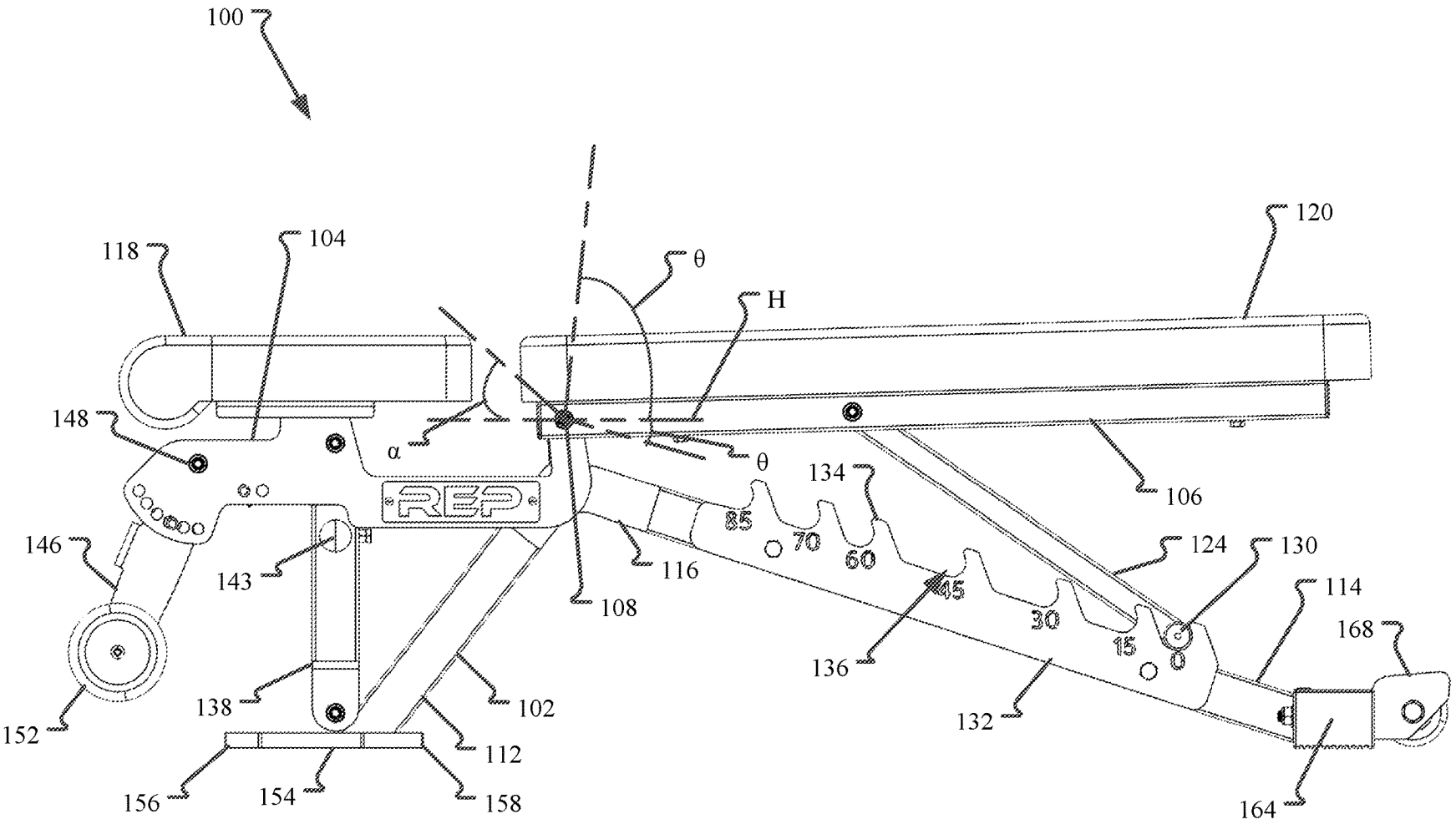
FIG. 3 depicts a side view of the adjustable bench.

FIG. 1 depicts a top perspective view of an exemplary adjustable bench 100. FIG. 2 depicts a bottom perspective view of the adjustable bench 100. FIG. 3 depicts a side view of the adjustable bench 100. Referring concurrently to FIGS. 1-3, the adjustable bench 100 includes a frame 102, a seat support 104, and a back support 106. The seat support 104 is connected to the frame 102 via a pivotable element 108 supported on the frame 102. The pivotable element 108 may be in the form of a roller or ball bearing, hinge, or other structure. Similarly, the back support 106 is coupled to the pivotable element 108. In other examples, the seat support 104 and the back support 106 may couple to the frame 102 with different and discrete pivotable elements. Typically, the adjustable bench 100 is used during exercise or to facilitate an exercise. Other benches can include more or fewer components (e.g., a frame formed from a greater or fewer number of discrete components joined together). The frame 102 provides stability to adjustable bench 100. The frame 102 also provides structure to which the seat support 104 and the back support 106 are connected.

Generally, the frame 102 includes a middle portion 110 connected to two leg portions, a leg seat portion 112 disposed at least partially under the seat support 104 and a leg back portion 114 disposed at least partially under the back support 106. In an aspect, the frame 102 is formed as "L" shape with the leg seat portion 112 shorter than the leg back portion 114. For example, the leg portions 112 and 114 can be connected to middle portion 110 via welding, bolt members, robust chemical adhesive, or the like. In this configuration, the pivotable element 108 is secured to the middle portion 110 of the frame 102 and at the elbow of the "L" shape. In an aspect, the pivotable element 108 may be supported by a pair of brackets 116 that separates the pivotable element 108 from the frame 102 and allows the seat support 104 and the back support 106 to move relative to the frame 102. In the example, the frame 102 and its portions 110, 112, 114 are formed from straight tubular components (e.g., hollow-rectangular tubular metal) so as to reduce unnecessary weight of the frame 102 and to increase manufacturing efficiencies and reduce bent tubing being used on the frame 102.

A seat cushion 118 is coupled to the seat support 104 and a back cushion 120 is coupled to the back support 106. Broadly, the cushions 118, 120 provide a surface to support the user in sitting or lying down positions. The back cushion 120 may be a relatively larger component of the adjustable bench 100 than the seat cushion 118. Adjustability of the positions of both cushions 118, 120 is described below.

Both the seat support 104 and the back support 106 independently pivot relative to the frame 102 about a pivot axis 122 of the pivotable element 108. The pivot axis 122 is orthogonal to the frame 102, seat support 104, and back support 106. Positioning of the back support 106 is provided by a brace 124 that is pivotably coupled thereto. The back support 106 may be formed by a pair of elongated members having a first end 126 coupled to the pivotable element 108. A second end 128 of the back support 106 is free and is pivotable around the pivot axis 122. The brace 124 has a first end that pivotably couples to the back support 106 at a position between the first end 126 and the second end 128. A second end of the brace 124 terminates at a pin 130 that may be selectively engaged with an adjustment ladder 132 secured to the frame 102 and the leg back portion 114. The adjustment ladder 132 has a plurality of teeth 134 defining gaps 136 for receiving the pin 130 of the brace 124. Positioning of the brace 124 along the adjustment ladder 132 adjusts a position of the back support 106 relative to the frame 102. The adjustment ladder 132 may also include indicia that may help a user position the pin 130 in a preferred gap 136 for a desired exercise. It is appreciated that movement of the back support 106 may be provided by any other structure as required or desired. For example, the back support may be connected alternatively to a curved arm with a plurality of apertures that selectively engage with a pin and a bracket disposed on the frame. Other mechanical systems may alternatively be used.

Figure 8:
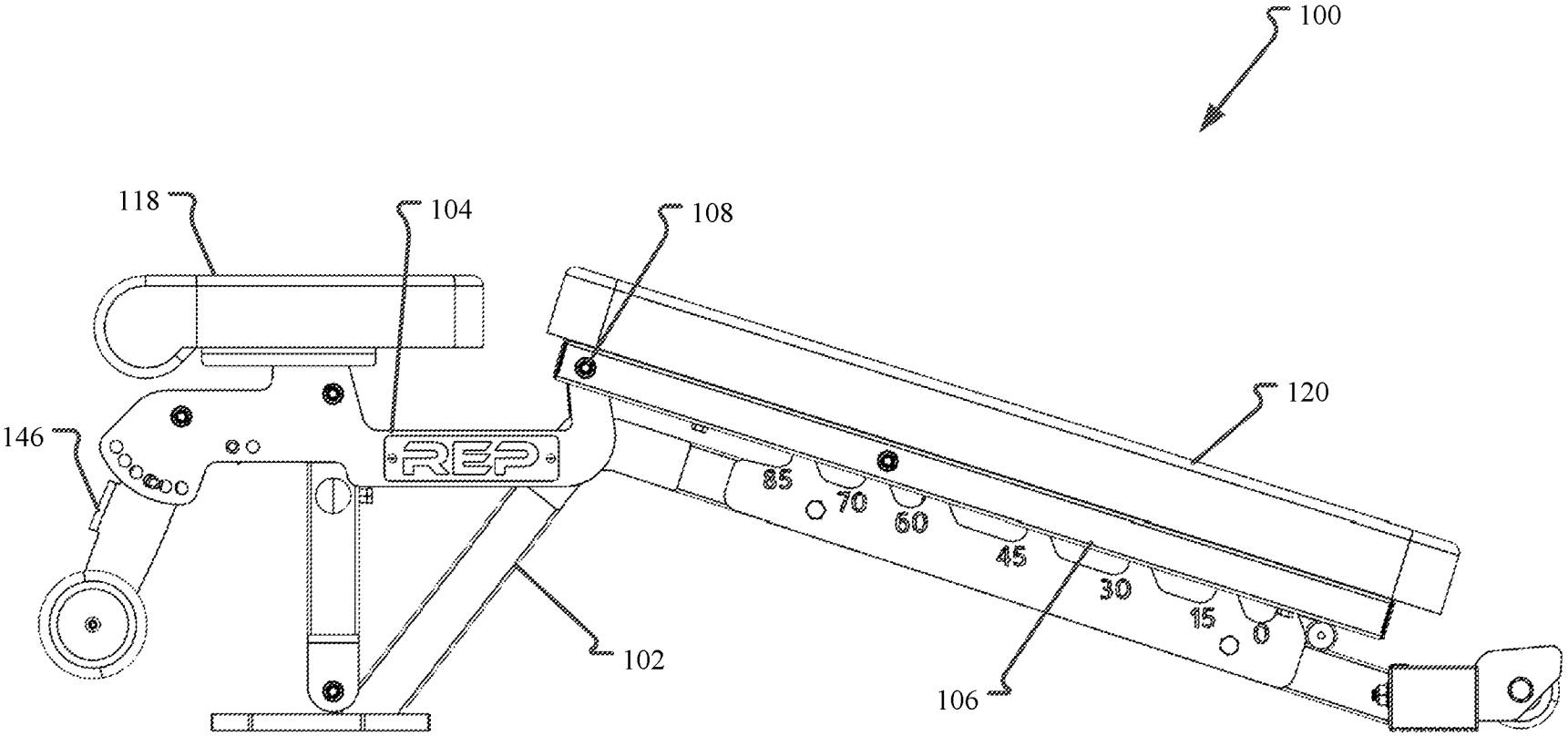

The back support 106 is pivotably adjustable in a range of motion relative to the frame 102 to allow for independent pivotal adjustability of the back cushion 120 relative to frame 102. Pivotal motion of the back support 106 is independent of pivotal motion of the seat support 104. A degree of pivoting of back support 106 is shown as angle θ relative to horizontal H in FIG. 3. In an aspect, the tolerance of the adjustable bench 100 may be around 3%. Pivoting above H is a positive value of θ and pivoting below H is a negative value of θ. In examples, the pivotal range of the back support 106 is at least 0° (that is, horizontal) and not greater than about 90° (vertical). In some examples, the pivotal range of motion of the back support 106 is not greater than about 85°. Relative to the horizontal, the back support 106 is capable of being positioned from about 0° to 90°. In another example, the back support 106 is capable of being positioned from about 0° to 85°. In another example, the pin 130 may be positioned outside of the adjustment ladder 132 and directly on the leg back portion 114 of the frame 102, which positions the back support 106 in a so-called decline use position, desirable for certain exercises. One example of the decline use position is shown in FIG. 8 and described further below. The decline use position may be a declined angle of up to about −5°, up to about −8°, up to about −10°, up to about −12°, up to about −20°, or more. In an aspect, the adjustment ladder 132 defines angular positions of the back cushion 120 relative to horizontal consisting only of 85°, 70°, 60°, 45°, 30°, 15°, 0°, and −12°. These angular positions increase efficiencies for the user.

Positioning of the seat support 104 is provided by a strut 138 that is coupled between the seat support 104 and the leg seat portion 112 of the frame 102. The seat support 104 may be formed by a pair of elongated members having a second end 140 coupled to the pivotable element 108. A first end 142 (shown in FIG. 2) of the seat support 104 is free and is pivotable around the pivot axis 122. The strut 138 has an adjustable length so as to set a pivot angle position of the seat support 104 and seat cushion 118 relative to horizontal. For example, the strut 138 is formed from a pair of telescoping members having a pin 143 that can selectively be disengaged so that the seat support 104 can pivot and slide the telescoping members relative to one another, adjusting the length of the strut 138, and then reengage with the telescoping members to set the length of the strut 138 and the angular position of the seat support 104. In an aspect, the strut 138 is pivotably coupled to both the seat support 104 and the frame 102 so as to enable the strut 138 to function as described herein. It is appreciated that movement of the seat support 104 may be provided by any other structure as required or desired. For example, the seat support may be connected to a curved arm with a plurality of apertures that selectively engage with a pin and a bracket disposed on the frame. Other mechanical systems may alternatively be used.

The seat support 104 is also pivotably adjustable in a range of motion relative to the frame 102 to allow for independent pivotal adjustability of the seat cushion 118 relative to frame 102. Pivotal motion of the seat support 104 is independent of pivotal motion of the back support 106. The seat support 104 pivots relative to the frame 102 about the pivot axis 122, described above. The seat support 104 is connected to the strut 138 that defines a plurality of adjustable length positions. A degree of pivoting of the seat support 104 is shown as angle α relative to horizontal H. Pivoting above H is a positive value of a and pivoting below H is a negative value of a. In examples, the pivotal range of motion of the seat support 104 is at least 0° (that is, horizontal) and not greater than about 90° (vertical). In some examples, the pivotal range of motion of seat support 104 is not greater than about 75°. Relative to the horizontal H, seat support 104 may be capable of pivoting from 0° to about −25° or greater. In an aspect, the angle α may only pivot to positive positions and can include 0°, 5°, 10°, 15°, and 20°.

The seat cushion 118 may be connected to the seat support 104 by one or more brackets 144 with fasteners 145 (e.g., bolts) or other elements. In the example, the seat cushion 118 is removably coupled to the seat support 104 so that the seat cushion 118 is configured to be oriented in at least two different directions on the seat support 104. For example, the seat cushion 118 may have a tapered shape and be substantially trapezoidal. As illustrated in the figures, the wide portion of the seat cushion 118 may be positioned away from the back cushion 120, while the narrow portion is adjacent to the back cushion 120. The seat cushion 118 can be removed via the fasteners 145 on the bracket 144 and the seat cushion 118 repositioned on the seat support 104 so that the narrow position of the seat cushion 118 is positioned away from the back cushion 120, while the wide portion is adjacent to the back cushion 120. Accordingly, the forward and rearward fasteners 145 are symmetrical to enable the reversal of the seat cushion 118 as required or desired. In examples, the seat support 104 maybe include structures that allow for sliding movement of the seat cushion 118 relative to the pivotable element 108, e.g., as described in numerous examples in U.S. Pat. No. 10,589,144, the disclosure of which is hereby incorporated by reference herein in its entirety.

The adjustable bench 100 also includes a leg support 146 pivotably coupled to the first end 142 of the seat support 104 at a pivot point 148 defining a rotation axis 150 for the leg support 146 relative to the seat support 104. The rotation axis 150 is substantially parallel to the pivot axis 122 of the pivotable element 108. The leg support 146 is substantially "T" shaped with a pair of opposing leg cushions 152 at the distal end of the leg support 146 opposite of the pivot point 148. In use, the leg cushions 152 enable users to secure ankles while using the adjustable bench 100 as required or desired (e.g., in a decline use position). The leg support 146 is pivotably adjustable relative to the seat support 104 and as described further below. In the example, the strut 138 is disposed between the leg support 146 and the pivotable element 108.

A front foot 154 is secured to the end of the leg seat portion 112 and disposed at least partially under the seat cushion 118. In the depicted example, the front foot 154 has a shape and size sufficient to resist wobbling or tilting both in a forward-backward direction and a side-to-side direction when the adjustable bench 100 is used for exercises. For example, the front foot 154 has a front end 156 facing the leg support 146 and an opposite rear end 158 facing the back support 106. The frame 102 is coupled to the front foot 154 at a location that is positioned towards the rear end 158. In an aspect, the leg seat portion 112 is within a rear half of a length of the front foot 154 between the front and rear ends 156, 158. In another aspect, the leg seat portion 112 is within a rear third of the length of the front foot 154 between the front and rear ends 156, 158. In still another aspect, the leg seat portion 112 is within a rear quarter of the length of the front foot 154 between the front and rear ends 156, 158. This configuration of the front foot 154 facilitates restricting or preventing the adjustable bench 100 from tilting forward when in use.

The front foot 154 also has a width 160 that is defined parallel to the rotation and pivot axes 150, 122. In an aspect, the width 160 of the front foot 154 is at least twice a width 162 of the frame 102 defined parallel to the rotation and pivot axes 150, 122. In another aspect, the width 160 of the front foot 154 is at least three times more than the width 162 of the frame 102 defined parallel to the rotation and pivot axes 150, 122. In still another aspect, the width 160 of the front foot 154 is at least four times more than the width 162 of the frame 102 defined parallel to the rotation and pivot axes 150, 122. This configuration increases side-to-side stability of the adjustable bench 100.

The frame 102 also includes a rear lateral support 164 secured to the end of the leg back portion 114 and disposed at least partially under the back cushion 120. The lateral support 164 provides stability to the adjustable bench 100 when in use. Rear feet 166 are disposed at each end of the lateral support 164. Two housings 168 also extend from the lateral support 164. Each housing 168 houses one or more rollers 170 to enable easy rolling movement of the adjustable bench 100. The lateral support 164 has a length 172 defined parallel to the rotation and pivot axes 150, 122 and the length 172 of the lateral support 164 is at least twice more than a width 174 of the back cushion 120 defined parallel to the rotation and pivot axes 150, 122. This increased width of the rear lateral support 164 increased overall stability of the adjustable bench 100.

Figure 4:
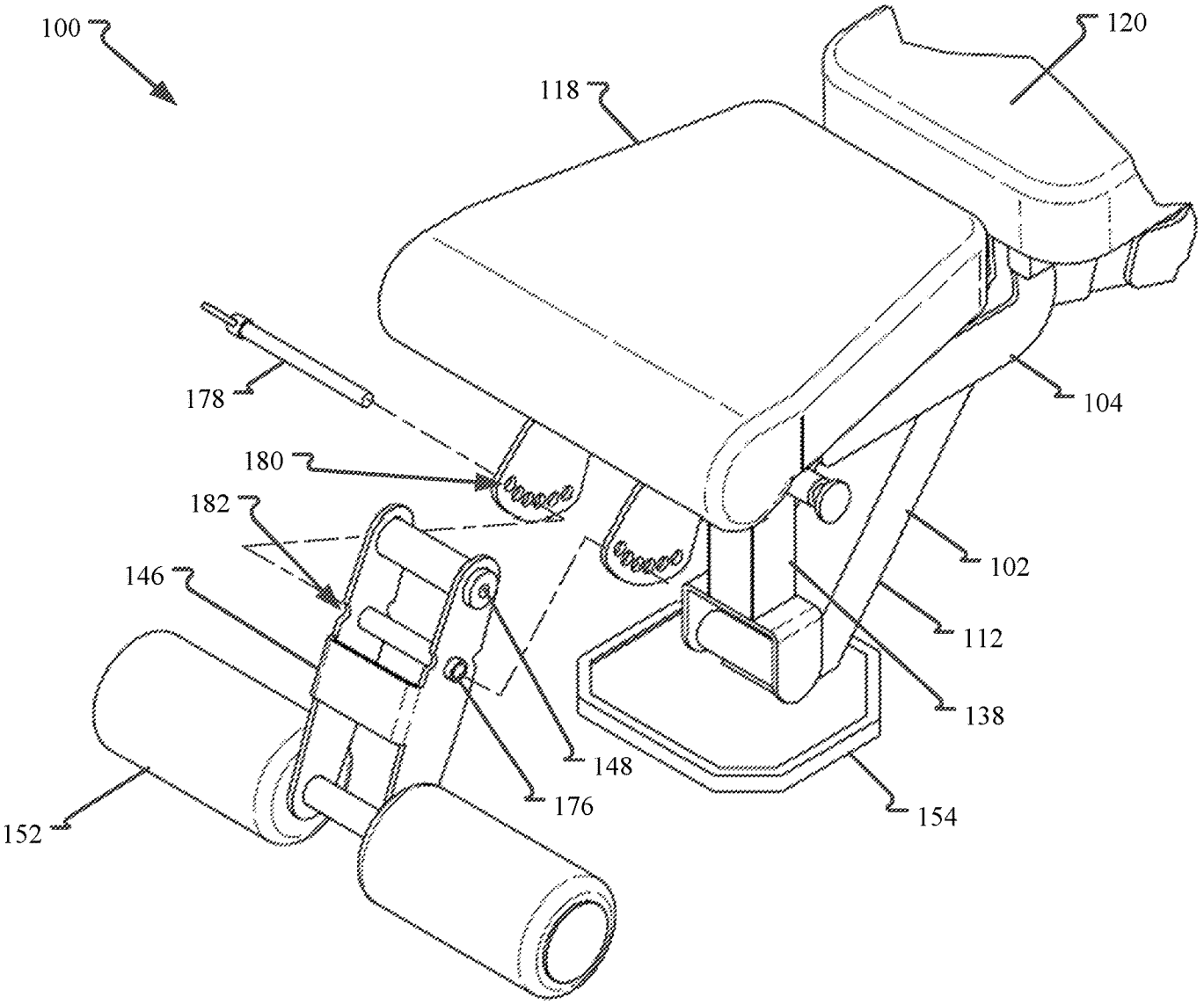
FIG. 4 depicts an exploded, partial perspective view of the adjustable bench, primarily illustrating a leg support.

FIG. 4 depicts an exploded, partial perspective view of the adjustable bench 100, primarily illustrating the leg support 146. Certain components are described above and are not necessarily described further. The leg support 146 has the leg cushions 152 that are disposed on one end thereof. The opposite end forms the pivot point 148 with the seat support 104. Between the pivot point 148 and the seat support 104, the leg support 146 includes a pin receiver 176. The pin receiver 176 extends through both plates forming the leg support 146 and is configured to at least partially receive a pin 178. Additionally, the first end 142 of the seat support 104 defines a plurality of apertures 180 within each plate shaped and sized to at least partially receive the pin 178. In the example, the apertures 180 are circumferentially spaced around the pivot point 148 between the leg support 146 and the seat support 104. The apertures 180 can be equally-spaced from each other so as to define the extension angle of the leg support 146 relative to the seat support 104. In other examples, the apertures 180 may not be equally spaced apart from one another. As illustrated in FIG. 4, six apertures 180 are defined within the seat support 104. In other examples, more or less than six apertures may be used as required or desired.

The leg support 146 is configured to selectively engage with the seat support 104 so as to define the extension angle position of the leg support 146 relative to the pivot point 148 and the seat support 104. In the example, the pin 178 is used to selectively engage the leg support 146 with the seat support 104 and define the extension angle position of the leg support 146. For example, the pin 178 has a length so that it can be extended through two opposing apertures 180 and the pin receiver 176 positioned therebetween. In another example, the length of the pin 178 can extend through the two opposing apertures 180 without capturing the pin receiver 176. As such, the pin 178, in combination with the apertures 180 and pin receiver 176, enables selectable pivoting and positioning of the leg support 146.

Additionally, the leg support 146 has a front side that faces out from the adjustable bench 100 and an opposite rear side that faces towards the strut 138 and the frame 102. Both the front and rear sides of the leg support 146 have notches 182 defined in each of the plates of the leg support 146. The notches 182 may be substantially aligned with the pin receiver 176 on the leg support 146. The notches 182 are shaped and sized to correspond to the size and shape of the pin 178.

In operation, the leg support 146 engages with the seat support 104 in at least a first configuration and a different second configuration. In the first configuration, the leg support 146 engages with the seat support 104 such that the leg support 146 is fixed at a predefined angular position relative to the pivot point 148. This predefined angular position is also selectable. The first configuration is illustrated in FIGS. 1-3 and occurs when the pin 178 engages with one set of apertures 180 of the seat support 104 and the pin receiver 176 of the leg support 146. In this first configuration, the leg support 146 is disposed in a fixed angular position relative to the seat support 104 and will not rotate around the pivot point 148 unless the pin 178 is removed. The spacing of the apertures 180 predefines the selectable angular position of the leg support 146 and in an aspect, each aperture 180 may correspond to a 13° position change of the leg support 146. Other predefined angular positions of the leg support 146, for example, greater than or less than 13° position change, may be used as required or desired.

Figure 5:
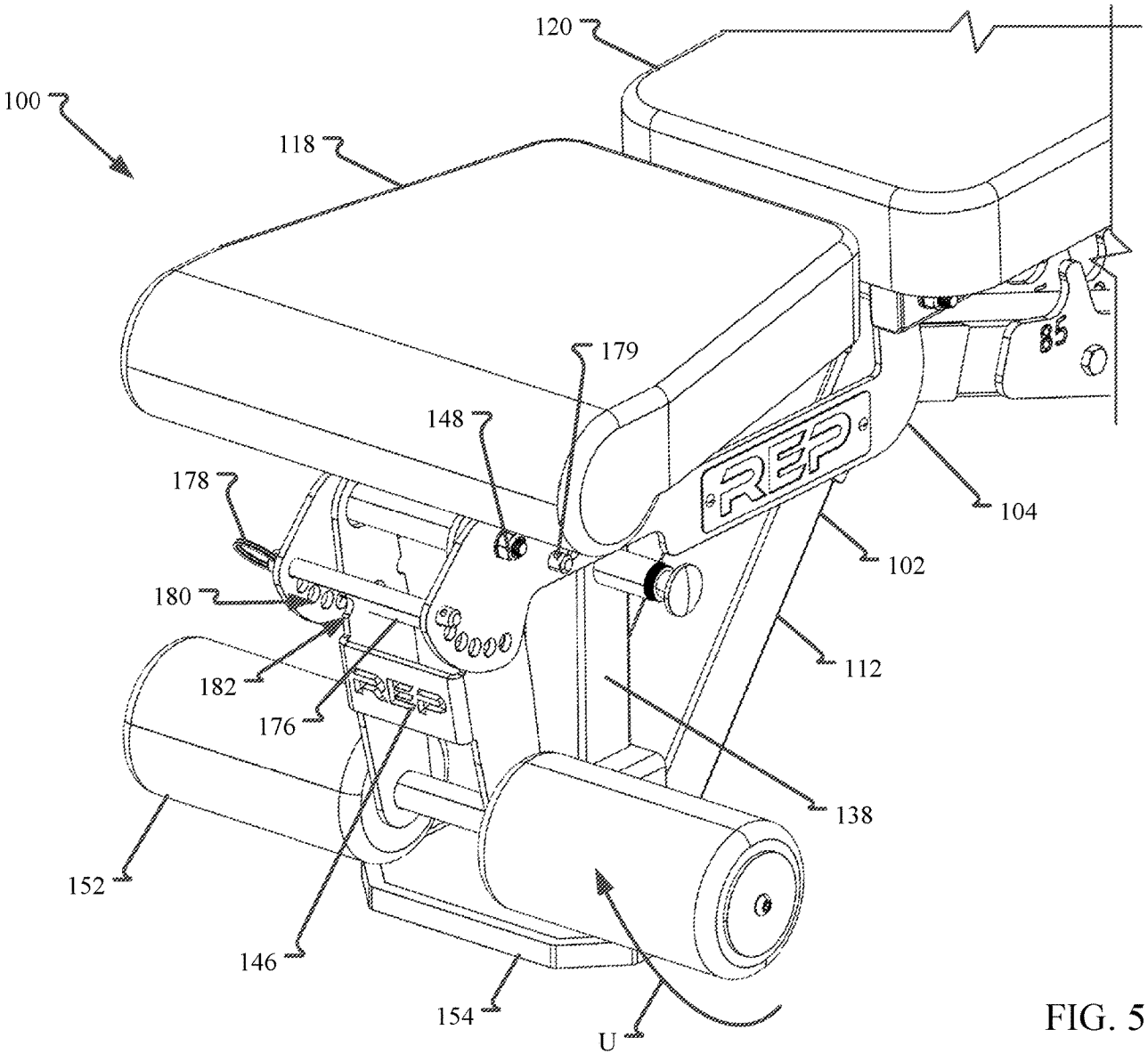
FIG. 5 depicts a partial perspective view the adjustable bench with the leg support in a second configuration.

In the second configuration, the leg support 146 engages with the seat support 104 such that a rotational stop is formed and the leg support 146 is freely rotatable around the pivot point 148 on one side of the rotational stop. The second configuration is illustrated in FIG. 5 and occurs when the pin 178 engages with one set of apertures 180 of the seat support 104 without capturing the pin receiver 176 of the leg support 146. In this second configuration, the leg support 146 is freely rotatable around the pivot point 148, but for the pin 178 which defines the rotational stop for the leg support 146. This disengagement of the pin 178 from the leg support 146 enables the leg support 146 to freely swing relative to the pivot point 148. The notches 182 are used in in the second configuration so that when the leg support 146 is disposed against the pin 178 acting as a rotational stop, the leg support 146 can be disposed at the predefined angular positions defined by the apertures 180. For example, the pin receiver 176 and the notches 182 of the leg support 146 are spaced apart at a similar 13° angle to the spacing of the apertures 180.

The second configuration allows users of the adjustable bench 100 to use the pin 178 as an upper or lower rotational stop limit so that the user can swing the leg support 146 into place during use, and then allow the leg support 146 to swing under the seat support 104 and out of the way after. As such, users can more easily facilitate two or more different workouts on the adjustable bench 100. It should be appreciated, that free rotation of the leg support 146 within the second configuration is with respect to the pivot point 148, and the adjustable bench 100 may have other components in addition to the pin 178 that may restrict full rotation around the rotation axis. For example, the strut 138 may prevent the leg support 146 from fully rotating around the rotation axis.

In the example, the leg support 146 engages with the seat support 106 with the insertable pin 178 and the plurality of apertures 180/pin receiver 176. It is appreciated that while the pin 178 is described herein, other engagement systems and mechanism may alternatively or additionally be used. For example, a spring biased slide pin may be coupled to one or both of the seat and leg support 106, 146. In other examples, a plurality of axial projections or bosses may selectively engage between the supports 106, 146, while axial movement between the supports 106, 146 can facilitate operation of the leg support 146 as described herein.

FIG. 5 depicts a partial perspective view of the adjustable bench 100 with the leg support 146 in the second configuration. Certain components are described above and are not necessarily described further. As illustrated in FIG. 5, the pin 178 is engaged with the apertures 180 defined in the seat support 104 and without capturing the pin receiver 176 of the leg support 146. As such, the leg support 146 is freely rotatable around the pivot point 148. However, the pin 178 defines a rotational stop such that the leg support 146 cannot rotate past the pin 178 in an upward direction U (e.g., in a direction away from the underlying surface). In this configuration, the user may swing the leg support 146 in the forward direction and against the pin 178 for a first workout type and then allow the leg support 146 to swing under the seat support 104 and out of the way for a different second workout type without withdrawing the pin 178. In this example, the strut 138 may also provide for a rotational stop in the back direction so that the leg support 146 may not fully rotate around the pivot point 148, but it can still freely swing back and forth. While the pin 178 forms an upper rotational stop in FIG. 5, in other examples, the pin 178 may alternatively form a lower rotational stop with the leg support 146 positioned above the pin 178 so that the leg support 146 cannot rotate past the pin 178 in a downward direction (e.g., in a direction towards the underlying surface).

In an example, a second pin 179 may be stored on the seat support 104. The second pin 179 may be used as a back-up pin, or for the second configuration if both upper and lower rotational stops are desired such that two pins 178, 179 are required.

Figure 6:
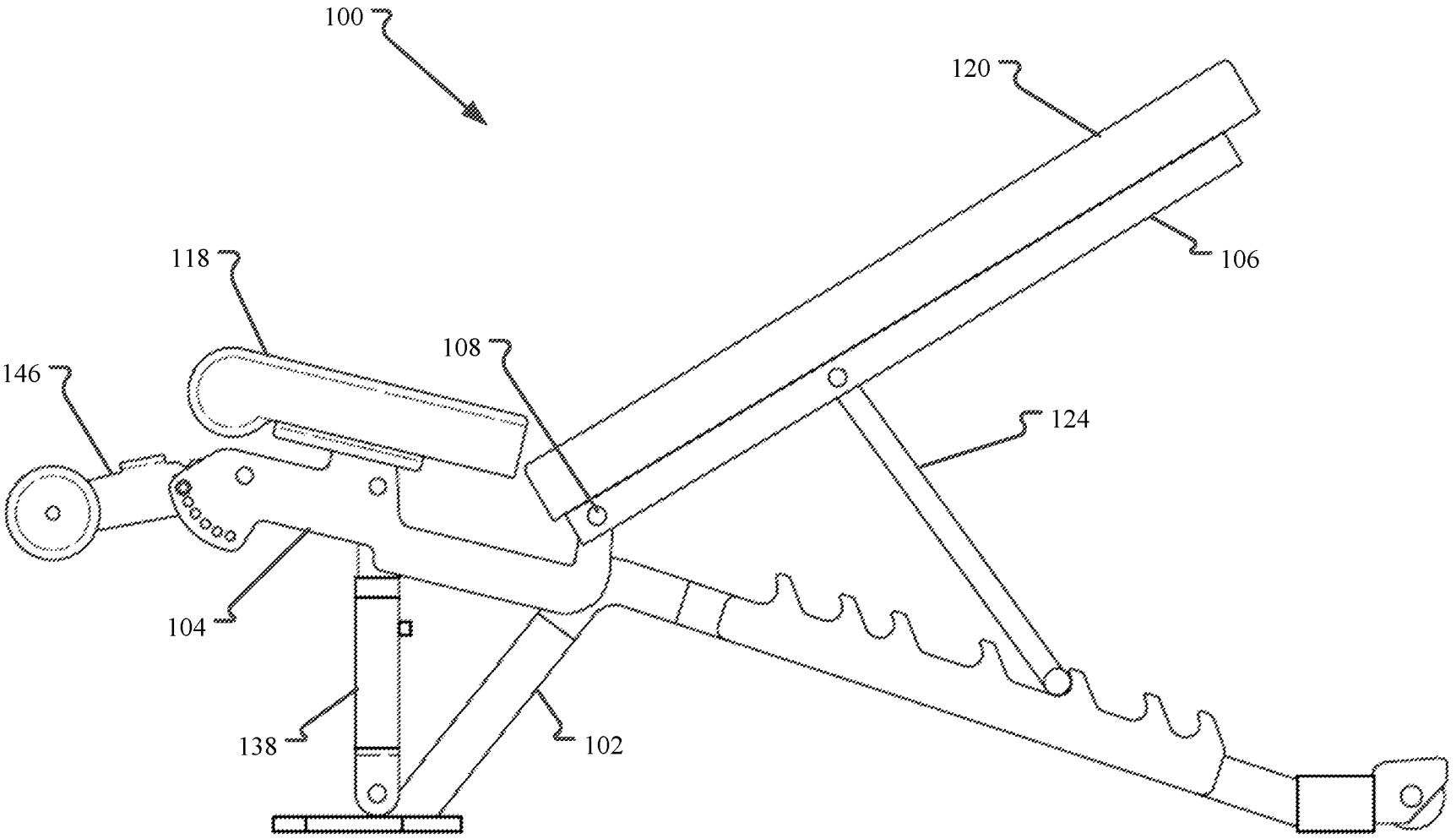
FIGS. 6-8 depict the adjustable bench in various use positions.
Figure 7:
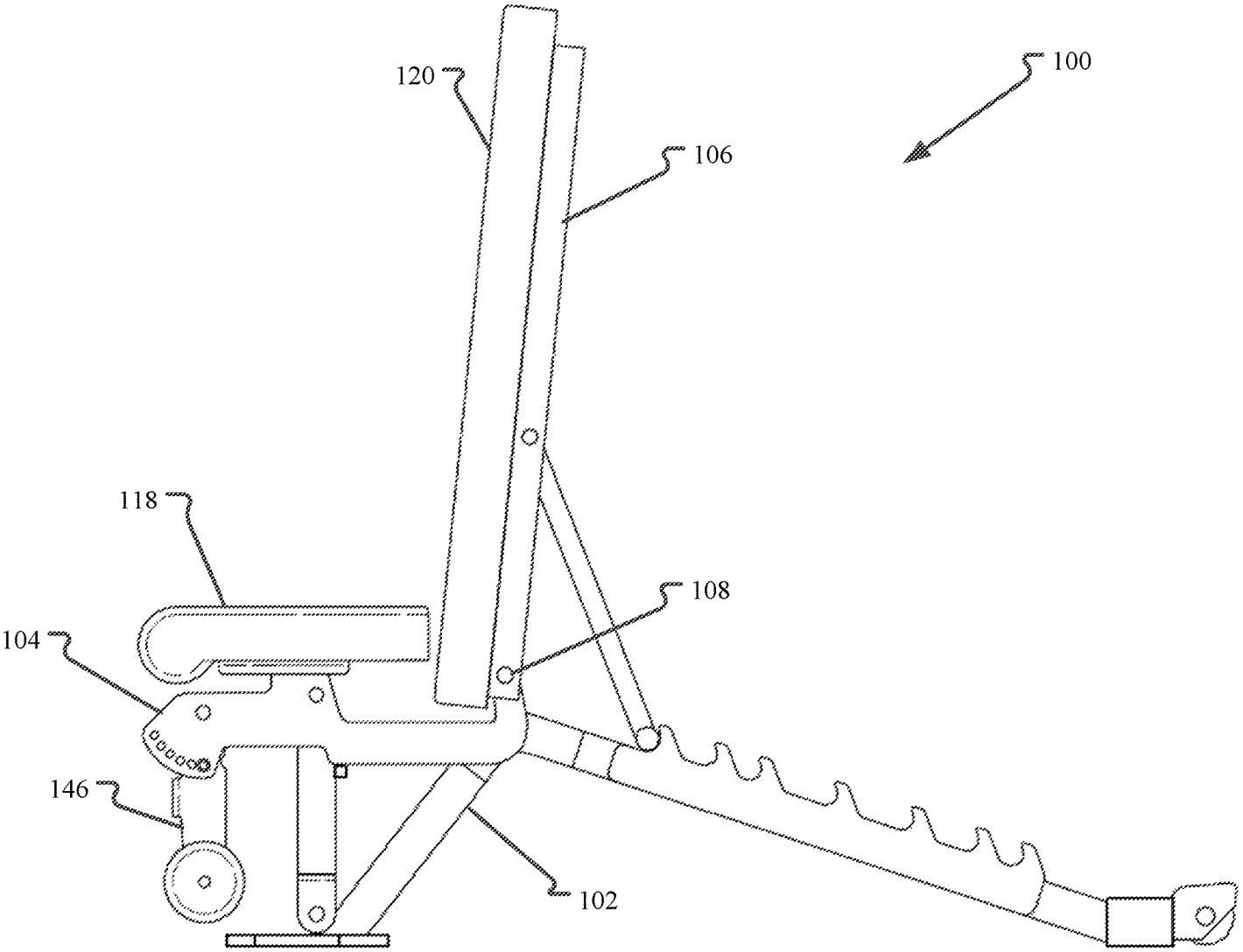

FIGS. 6-8 depict the adjustable bench 100 in various use positions. Starting first with reference to FIG. 3, the adjustable bench 100 is shown with the seat cushion 118 and the back cushion 120 in a substantially horizontal use position. In an aspect, the back cushion 120 may not lay at exactly a 0° horizontal angle, but may have a slight incline while still being in the horizontal use position. In an aspect, this slight incline may be within the tolerance of the bench (e.g., 3%). In the horizontal use position, the leg support 146 may be in the first configuration (as illustrated), whereby the leg cushions 152 are at a fixed angle relative to the seat cushion 118. Alternatively, in the horizontal use position, the leg support 146 may be in the second configuration as required or desired. The first and second configurations of the leg support 146 are independent from the position of the seat cushion 118 and the back cushion 120.

Turning next to FIG. 6, the adjustable bench 100 is shown with the seat cushion 118 in a declined use position, while the back cushion 120 is shown in an inclined use position. As used herein, inclined orientations are relative to the front (e.g., the leg support 146 of the adjustment bench 100) so as to keep the user upright and above horizontal while declined orientation are relative to the front so as to position the user below horizontal. Both the seat support 104 and the back support 106 are independently moveable relative to the pivotable element 108. The pivot position of the seat support 104 is maintained by the strut 138 coupled between the frame 102 and the seat support 104. The pivot position of the back support 106 is maintained by the brace 124 coupled between the frame 102 and the back support 106. While a single declined use position is illustrated with the seat cushion 118 and a single inclined use position is illustrated with the back cushion 120, multiple different declined and inclined use positions are enabled by the adjustable bench 100 and predefined therein. The leg support 146 may be disposed in either the first configuration or the second configuration as required or desired. As shown in FIG. 6, the leg support 146 is in the first configuration and at a fixed angle with respect to the seat support 104. Because the leg support 146 is coupled to the end of the seat support 104, the leg support 146 moves with the seat cushion 118 and then can be secondarily positioned at various extension angles accommodated by the first and second configurations as described herein.

In FIG. 7, the adjustable bench 100 is shown with the seat cushion 118 in the horizontal use position, while the back cushion 120 is shown in the inclined use position because the seat support 104 is independent from the back support 106. The leg support 146 may be disposed in either the first configuration or the second configuration as required or desired. As shown in FIG. 7, the leg support 146 is in the first configuration and at a fixed angle with respect to the seat support 104. Alternatively, the leg support 146 may be useable in the second configuration as required or desired. In an aspect, the seat cushion 118 may only extend between the horizontal use position and a declined use position.

In FIG. 8, the adjustable bench 100 is shown with the seat cushion 118 in the horizontal use position, while the back cushion 120 is shown in a declined use position. In an aspect, the seat cushion 118 may be positioned in a declined use position (shown in FIG. 6), when the back cushion 120 is in the declined used position as the seat support 104 is independent from the back support 106. The leg support 146 may be disposed in either the first configuration or the second configuration as required or desired. As shown in FIG. 8, the leg support 146 is in the first configuration and at a fixed angle with respect to the seat support 104. Alternatively, the leg support 146 may be useable in the second configuration as required or desired.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified examples and examples. In this regard, any number of the features of the different examples described herein may be combined into one single example and alternate examples having fewer than or more than all of the features herein described are possible.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. An adjustable bench comprising:

a frame;

a hinge coupled to the frame;

a back support having an end pivotably coupled to the hinge;

a back cushion coupled to the back support;

a seat support having a first seat support end and a second seat support end pivotably coupled to the hinge;

a seat cushion coupled to the seat support;

a strut coupled between the seat support and the frame, the strut having an adjustable length so as to define a pivot angle position of the seat cushion; and a leg support pivotably coupled to the first seat support end at a pivot point directly underneath the seat cushion and defining a rotation axis for the leg support relative to the seat support, wherein the leg support is selectively engageable with the seat support in at least a first configuration and a second configuration;

in the first configuration, the leg support engages with the seat support such that the leg support is fixed at a predefined angular position relative to the rotation axis; and in the second configuration, the leg support engages with the seat support such that a rotational stop is formed and the leg support is at least partially freely rotatable about the rotational axis on one side of the rotational stop.

2. The adjustable bench of claim 1, further comprising a pin configured to selectively engage with the seat support and the leg support to define the first configuration and the second configuration.

3. The adjustable bench of claim 2, wherein a plurality of apertures are defined within the seat support and a pin receiver is defined within the leg support, each of the plurality of apertures and the pin receiver configured to receive at least a portion of the pin.

4. The adjustable bench of claim 2, wherein the leg support has a first side and an opposite second side, each of the first and second sides having a notch shaped and sized to at least partially receive the pin when in the second configuration.

5. The adjustable bench of claim 1, wherein the first configuration has a plurality of predefined angular positions.

6. The adjustable bench of claim 1, wherein the strut is disposed between the leg support and the hinge.

7. The adjustable bench of claim 1, wherein the seat cushion is removably coupled to the seat support, the seat cushion configured to secure to the seat support in at least two different orientations.

8. An adjustable bench comprising:

a frame;

a hinge coupled to the frame;

a back support having an end pivotably coupled to the hinge;

a back cushion coupled to the back support;

a seat support having a first seat support end defining a plurality of apertures and a second seat support end pivotably coupled to the hinge;

a seat cushion coupled to the seat support;

a leg support pivotably coupled to the first seat support end at a pivot point underneath the seat cushion and defining a rotation axis for the leg support relative to the seat support; and a pin, wherein the leg support is selectively engageable with each of the plurality of apertures via the pin in at least a first configuration and a second configuration, wherein in the first configuration for each selected one of the plurality of apertures, the pin also engages with the leg support to define a corresponding fixed angular position of the leg support relative to the seat support that is different in angular position from unselected ones of the plurality of apertures when engaged by the pin, and in the second configuration for each selected one of the plurality of apertures, the pin is engaged with the selected one of the plurality of apertures without capturing the leg support such that the pin defines a corresponding rotational stop for the leg support and the leg support is movable at least partially around the rotational axis.

9. The adjustable bench of claim 8, further comprising a strut coupled between the seat support and the frame, the strut having an adjustable length so as to define a pivot angle position of the seat cushion relative to a horizontal axis.

10. The adjustable bench of claim 9, wherein the strut is pivotably coupled to both the seat support and the frame.

11. The adjustable bench of claim 8, wherein the leg support includes a pin receiver that selectively corporates with each of the plurality of apertures to receive the pin in the first configuration.

12. The adjustable bench of claim 8, wherein at least one notch is defined on the leg support to at least partially receive the pin in the second configuration.

13. The adjustable bench of claim 8, wherein the plurality of apertures are circumferentially spaced relative to the pivot point.

14. The adjustable bench of claim 8, wherein the seat cushion is tapered, and the seat cushion is removable coupled to the seat support such that the seat cushion is configured to be oriented in at least two different directions.

15. The adjustable bench of claim 8, further comprising a front foot secured to the frame and disposed at least partially under the seat cushion, wherein the front foot has a front end facing the leg support and an opposite rear end facing the back support, and wherein the frame is positioned towards the rear end and within a rear third of a length of the front foot between the front end and the rear end.

16. The adjustable bench of claim 8, further comprising a front foot secured to the frame and disposed at least partially under the seat cushion, wherein the front foot has a width defined parallel to the rotation axis, the width of the front foot at least three times more than a width of the frame defined parallel to the rotational axis.

17. The adjustable bench of claim 8, further comprising a rear lateral support secured to the frame and disposed at least partially under the back cushion, wherein the rear lateral support has a length defined parallel to the rotational axis, the length of the lateral support is at least twice more than a width of the back cushion defined parallel to the rotational axis.

18. The adjustable bench of claim 8, further comprising:

an adjustment ladder secured to the frame; and a brace extending from and pivotably connected to the back support, wherein a terminal end of the brace is selectively engageable with the adjustment ladder, and wherein positioning of the brace along the adjustment ladder adjusts a position of the back support relative to the frame, wherein the adjustment ladder includes of a plurality of gaps defined in the adjustment ladder and configured to selectively receive the terminal end of the brace, the adjustment ladder defining angular positions of the back cushion relative to a horizontal axis consisting of 85°, 70°, 60°, 45°, 30°, 15°, 0°, and −12°.

19. The adjustable bench of claim 8, wherein the frame includes a leg seat portion disposed at least partially under the seat support and a leg back portion disposed at least partially under the back support, the leg seat portion and the leg back portion being straight tubular components.

20. An adjustable bench comprising:

a frame;

a hinge coupled to the frame;

a back support having an end pivotably coupled to the hinge;

a back cushion coupled to the back support;

a seat support having a first seat support end and a second seat support end pivotably coupled to the hinge, the first seat support end having a plurality of apertures defined therein;

a seat cushion coupled to the seat support;

a strut coupled between the seat support and the frame, the strut having an adjustable length so as to define a pivot angle position of the seat cushion;

a leg support pivotably coupled to the first seat support end at a pivot point disposed at least partially above the plurality of apertures in the seat support and underneath the seat cushion, and defining a rotation axis for the leg support relative to the seat support, the leg support including a pin receiver; and a pin, wherein in a first configuration, the pin engages with one of the plurality of apertures in the seat support and the pin receiver in the leg support to define a fixed angular position of the leg support relative to the seat support in a different in angular position from others of the plurality of apertures when such are engaged by the pin; and in a second configuration, the pin only engages with one of the plurality of apertures in the seat support such that a rotational stop is formed and the leg support is at least partially freely rotatable on one side of the pin.

* * * * *